US007156432B2

(12) United States Patent
Sledge et al.

(10) Patent No.: US 7,156,432 B2
(45) Date of Patent: Jan. 2, 2007

(54) OPERATOR CATCH CARTRIDGE ASSEMBLY FOR A DOOR HANDLE SET

(75) Inventors: Emily Karleen Meredith Sledge, Aliso Viejo, CA (US); Steven Armstrong, San Juan Capistrano, CA (US)

(73) Assignee: Newfrey, LLC, Newark, DE (US)

( * ) Notice: Subject to any disclaimer, the term of this patent is extended or adjusted under 35 U.S.C. 154(b) by 183 days.

(21) Appl. No.: 10/853,452

(22) Filed: May 24, 2004

(65) Prior Publication Data

US 2005/0258654 A1 Nov. 24, 2005

(51) Int. Cl.
*E05B 3/00* (2006.01)

(52) U.S. Cl. ..... 292/358; 292/DIG. 64; 292/DIG. 61

(58) Field of Classification Search ..... 292/336.3, 292/348, 352, 353, 355, DIG. 53, DIG. 64, 292/DIG. 61
See application file for complete search history.

(56) References Cited

U.S. PATENT DOCUMENTS

| | | | | |
|---|---|---|---|---|
| 818,565 | A | 4/1906 | Schwarz | |
| 2,046,831 | A | 7/1936 | Lowe | 70/46 |
| 2,163,101 | A | 6/1939 | Newton | 292/348 |
| 2,301,751 | A | 11/1942 | Schlage | 70/224 |
| 2,827,323 | A | 3/1958 | Kessel et al. | 292/352 |
| 2,842,389 | A | 7/1958 | Muttart | 292/352 |
| 2,961,268 | A | 11/1960 | Russell et al. | 292/352 |
| 3,427,061 | A * | 2/1969 | Gresham et al. | 292/353 |
| 3,824,817 | A | 7/1974 | Orr | 70/81 |
| 3,907,346 | A * | 9/1975 | Van Klompenburg | 292/127 |
| 4,012,928 | A | 3/1977 | Dauenbaugh | 70/81 |
| 4,342,478 | A | 8/1982 | Foshee | 292/352 |
| 4,394,821 | A * | 7/1983 | Best et al. | 70/422 |
| 5,301,526 | A | 4/1994 | Fann et al. | 70/224 |
| 5,476,295 | A | 12/1995 | Smallegan et al. | 292/336.3 |
| 5,782,119 | A * | 7/1998 | Ellis et al. | 70/371 |
| 5,884,510 | A | 3/1999 | Crocco et al. | 70/34 |
| 5,947,537 | A * | 9/1999 | Aigner et al. | 292/352 |
| 6,470,721 | B1 | 10/2002 | Ming | 70/224 |
| 6,575,006 | B1 | 6/2003 | Don | 70/472 |
| 6,575,503 | B1 | 6/2003 | Johansson et al. | 292/170 |
| 6,595,713 | B1 | 7/2003 | Wilson | 403/7 |
| 6,616,200 | B1 | 9/2003 | Tiesler | 292/164 |

FOREIGN PATENT DOCUMENTS

GB 2262770 A 6/1993

* cited by examiner

*Primary Examiner*—Gary Estremsky
(74) *Attorney, Agent, or Firm*—Richard J. Veltman, Esq.; Taylor & Aust, P.C.; Ronald K. Aust, Esq.

(57) ABSTRACT

A handle set includes an operator having a retention slot. A chassis is provided for mounting the operator. The chassis includes a sleeve having a bore, and an opening extending through the sleeve to the bore. An operator catch cartridge assembly is configured for mounting to the chassis via the opening. The operator catch cartridge assembly includes a housing defining a guide channel. An operator catch is positioned in the guide channel for sliding engagement with the housing. A biasing member biases the operator catch with respect to the housing. The operator catch engages the retention slot in the operator when the operator is received over the sleeve of the chassis.

17 Claims, 6 Drawing Sheets

OPERATOR CATCH CARTRIDGE ASSEMBLY FOR A DOOR HANDLE SET

BACKGROUND OF THE INVENTION

1. Field of the Invention

The present invention relates to a door handle set, and, more particularly, to an operator catch.

2. Description of the Related Art

Handle sets have long been available that include an operator, e.g., knob or lever, for retracting a latch bolt. In order to accommodate various operator configurations, a handle set may be equipped with an operator catch which, when retracted, permits removal of one operator, e.g., a door knob, and replacement with another operator, e.g., a lever.

During the assembly of a typical handle set, a chassis is provided to mount the operator. The individual components that make up an operator catch mechanism, including for example, springs and the operator catch, are assembled within the chassis. Such an assembly process, however, may be awkward and time consuming.

What is needed in the art is an apparatus and method for reducing the difficulty in assembling a handle set that includes an operator catch mechanism.

SUMMARY OF THE INVENTION

The present invention provides an apparatus and method for reducing the difficulty in assembling a handle set that includes an operator catch mechanism.

The present invention, in one form thereof, relates to a handle set. The handle set includes an operator having a retention slot. A chassis is provided for mounting the operator. The chassis includes a sleeve having a bore, and an opening extending through the sleeve to the bore. An operator catch cartridge assembly is configured for mounting to the chassis via the opening. The operator catch cartridge assembly includes a housing defining a guide channel. An operator catch is positioned in the guide channel for sliding engagement with the housing. A biasing member biases the operator catch with respect to the housing. The operator catch engages the retention slot in the operator when the operator is received over the sleeve of the chassis.

In another form thereof, the present invention relates to an operator catch cartridge assembly. The operator catch cartridge assembly is configured for mounting as a unit to a chassis, and the chassis is configured to receive an operator. The operator catch cartridge assembly includes a housing defining a guide channel. An operator catch is positioned in the guide channel for sliding engagement with the housing. A biasing member is provided for biasing the operator catch with respect to the housing. The operator catch is configured to engage a retention slot in the operator to retain the operator on the chassis.

In another form thereof, the present invention relates to a method of assembling an operator catch cartridge assembly, including the steps of providing a housing having a guide channel, a keeper formed along the guide channel, and at least one chamber; loading a biasing member into the chamber of the housing; sliding an operator catch into the guide channel of the housing to engage the biasing member; and continuing sliding the operator catch into the guide channel until a retainer surface of the operator catch snaps past the keeper of the housing.

In another form thereof, the present invention relates to a method of assembling a handle set. The method includes the steps of assembling an operator catch cartridge assembly as a unit, the operator catch cartridge assembly including a housing defining a guide channel, an operator catch positioned in the guide channel for sliding engagement with the housing, and a biasing member for biasing the operator catch with respect to the housing; inserting the operator catch cartridge assembly into an opening in a chassis, the chassis having an operator sleeve; and sliding a barrel portion of an operator over the operator sleeve, the barrel portion having a retention slot, the operator catch of the operator catch cartridge assembly engaging the retention slot in the operator to retain the operator on the operator sleeve.

An advantage of the present invention is that assembling a handle set is simplified.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1A:
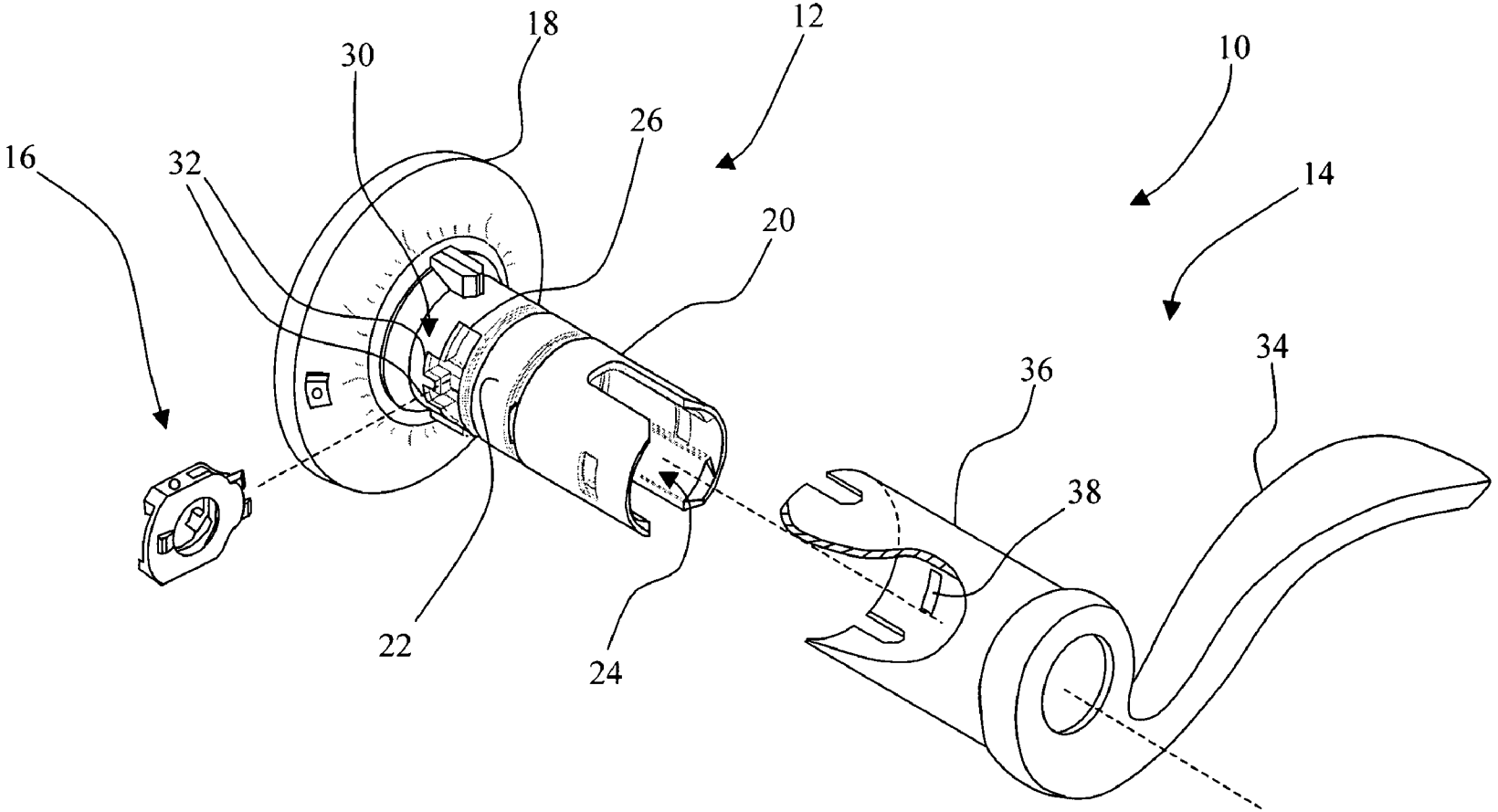
FIG. 1A is an exploded perspective view of a handle set embodying the present invention, with a portion of an operator broken away.

Referring to FIG. 1A, there is shown a handle set 10 in accordance with the present invention. Handle set 10 includes a chassis 12, an operator 14, and an operator catch cartridge assembly 16. Handle set 10 includes other components (not shown), such as for example, a door latch bolt and actuation mechanism, which for brevity will not discussed herein, since such components are well known to those of ordinary skill in the art, and their description is not necessary to the understanding of the present invention.

Chassis 12 is provided for mounting operator 14. Chassis 12 includes a mounting portion 18 and an operator sleeve 20. Mounting portion 18 is configured for attachment to a planar face of a door, in a manner well known in the art. Operator sleeve 20 is affixed to mounting portion 18.

Figure 1B:
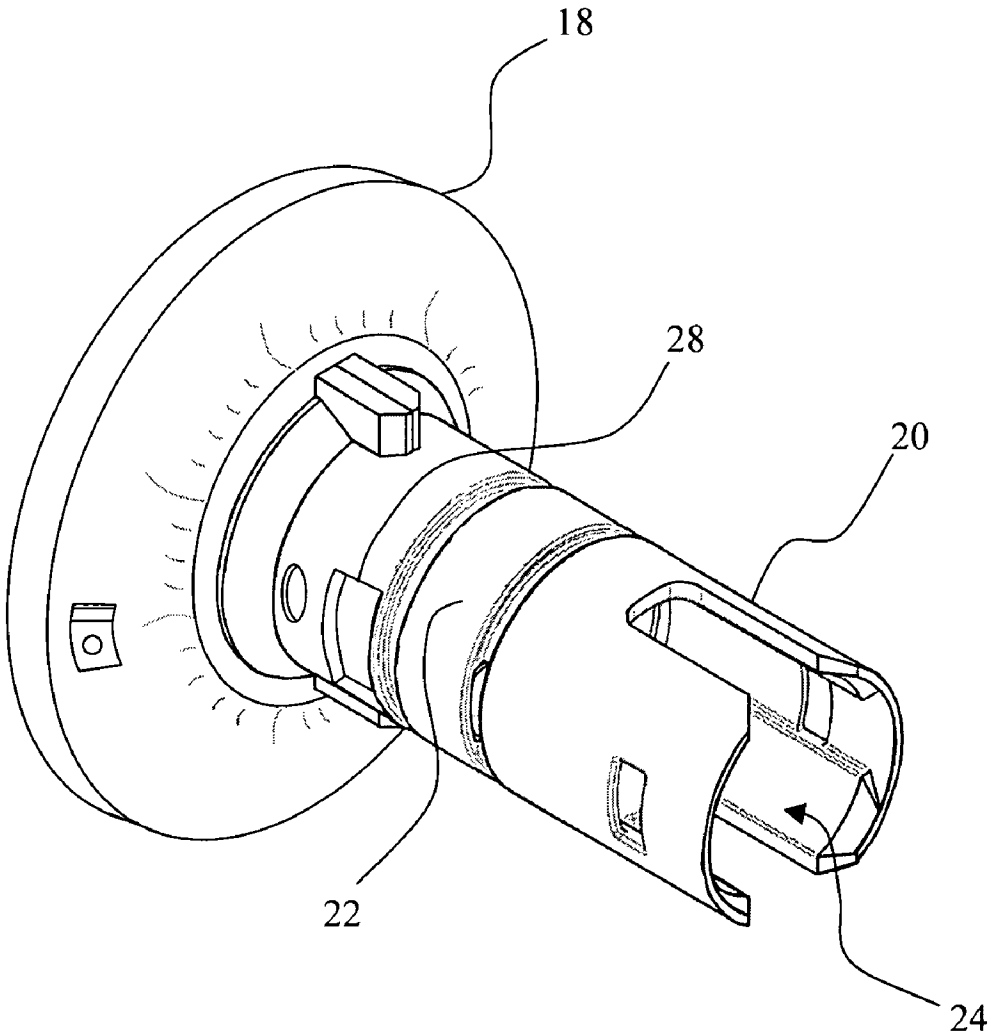
FIG. 1B is a perspective view of a side of a chassis opposite to the side of the chassis shown in FIG. 1A.

Operator sleeve 20 includes a cylindrical wall 22, a bore 24, a first opening 26, and a second opening 28. Second opening 28 is best viewed in FIG. 1B. First opening 26 extends through cylindrical wall 22 of operator sleeve 20 to bore 24. Second opening 28 extends through cylindrical wall 22 of operator sleeve 20 to bore 24, and is positioned opposite to first opening 26. First opening 26 of operator sleeve 20 of chassis 12 defines a keyway 30. Keyway 30 includes a plurality of key slots 32.

Operator 14 may be, for example, a lever or a doorknob. Operator 14 includes an actuator portion 34 and a barrel portion 36. Barrel portion 36 is sized and configured to be received in sliding engagement over operator sleeve 20 of chassis 12. Formed in barrel portion 36 of operator 14 is a retention slot 38.

As shown in FIG. 1A, operator catch cartridge assembly 16 is configured for insertion as a unit into chassis 12 via first opening 26.

Figure 2:
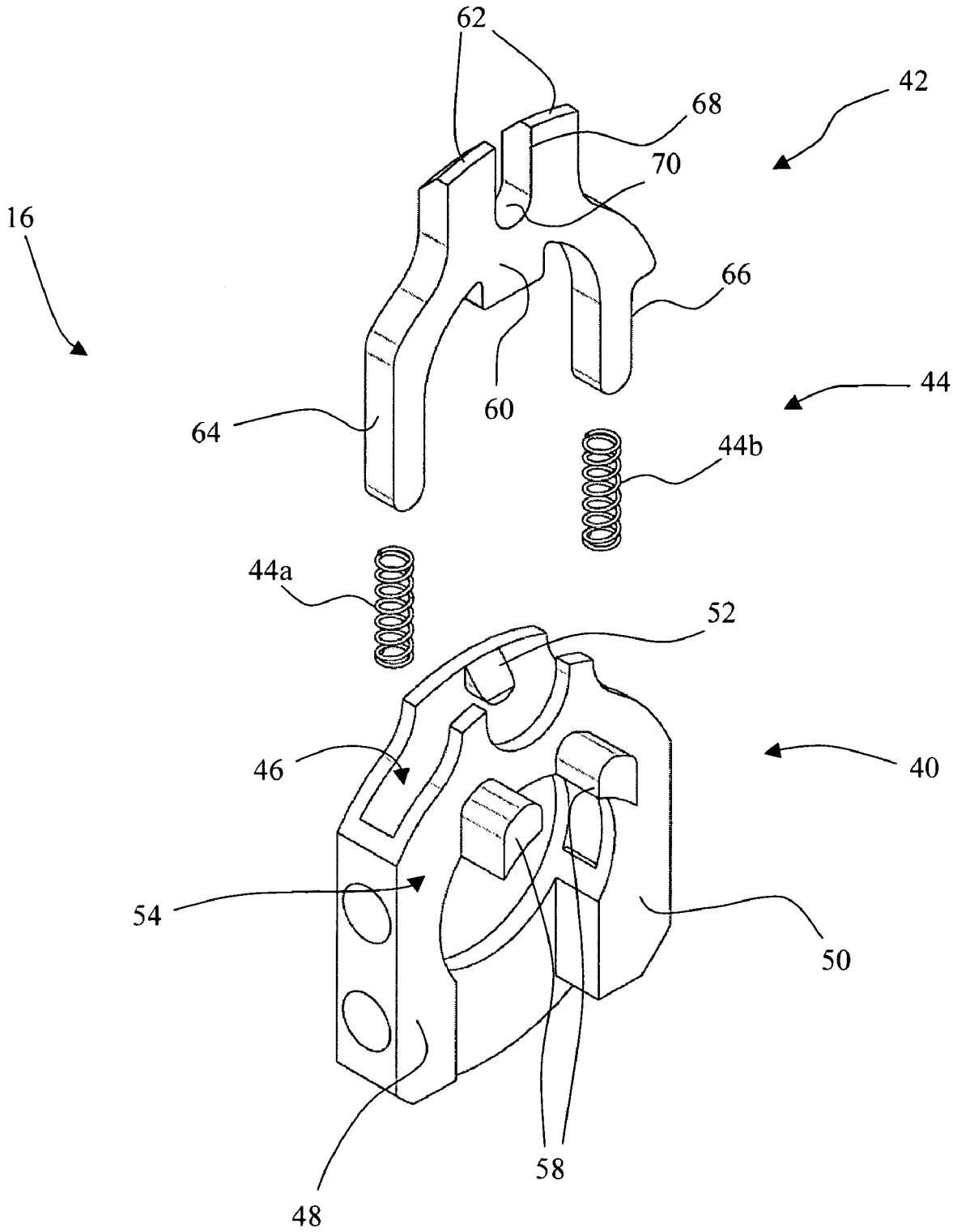
FIG. 2 is an exploded perspective view of an operator catch cartridge assembly in accordance with the present invention.
Figure 3:
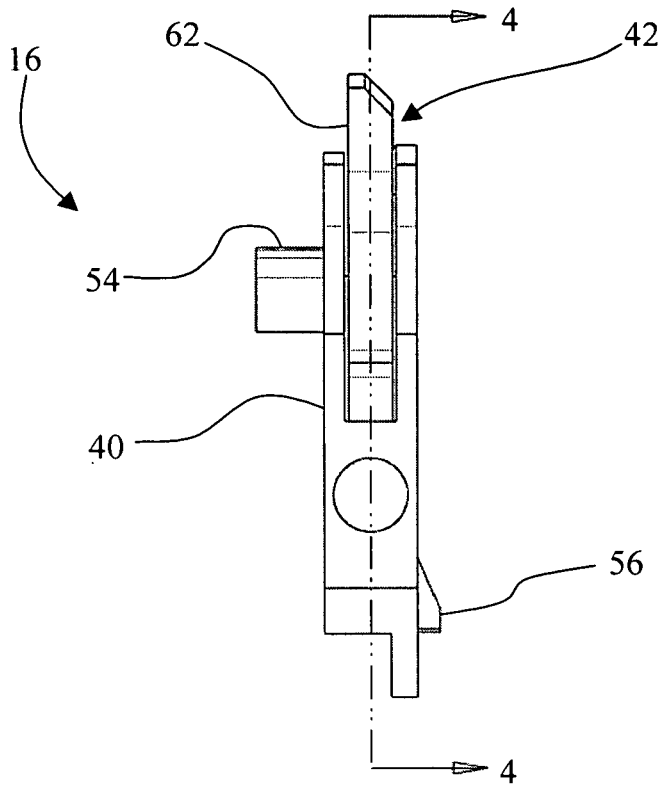
FIG. 3 is a side view of the operator catch cartridge assembly of FIG. 2, in an assembled state.
Figure 4:
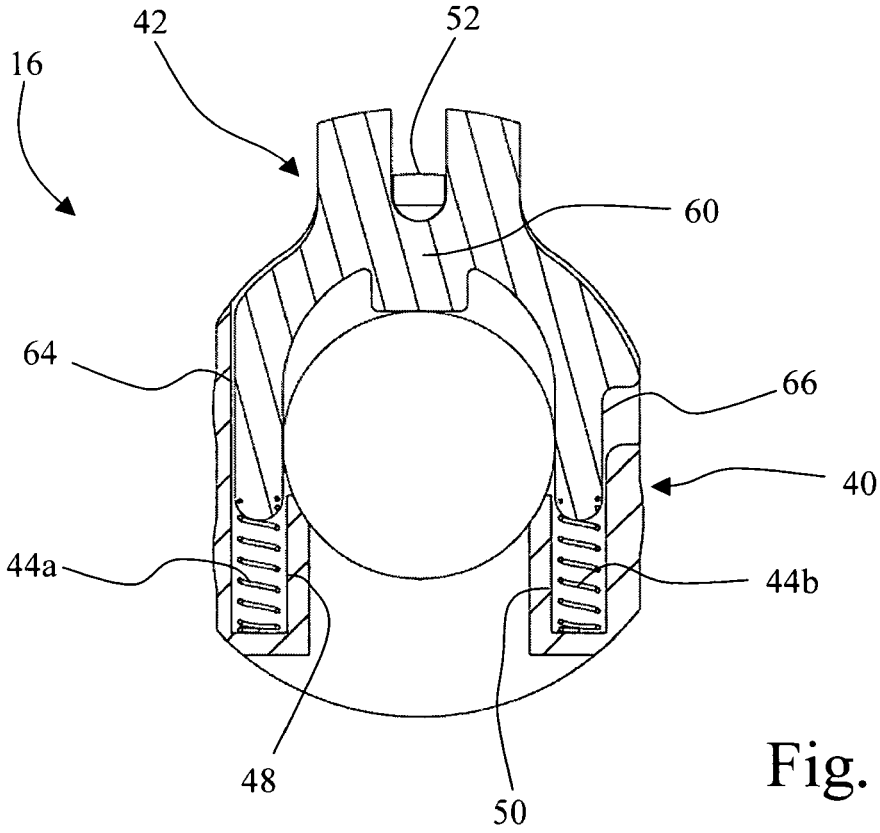
FIG. 4 is a sectional view of the operator catch cartridge assembly taken along line 4—4 of FIG. 3

Referring to FIGS. 2–4, operator catch cartridge assembly 16 includes a housing 40, an operator catch 42, and a biasing member 44. Once operator catch cartridge assembly 16 is assembled and installed in chassis 12, operator catch 42 extends from second opening 28 in operator sleeve 20. In turn, operator catch 42 engages retention slot 38 in barrel portion 36 of operator 14 when operator 14 is received over operator sleeve 20 of chassis 12.

In a preferred embodiment, housing 40 is made from plastic. Housing 40 defines a guide channel 46, a first spring chamber 48 and a second spring chamber 50. As shown, biasing member 44 may be in the form of a first spring 44*a* and a second spring 44*b*. Springs 44*a*, 44*b* are respectively located in first spring chamber 48 and second spring chamber 50. Operator catch 42 is positioned in guide channel 46 for sliding engagement with housing 40. Biasing member 44, i.e., springs 44*a*, 44*b*, biases operator catch 42 with respect to housing 40.

Housing 40 includes a keeper 52, a key 54 and a retainer 56. Keeper 52 is formed in the interior of housing 40 along guide channel 46, and each of key 54 and retainer 56 are formed at an exterior of housing 40. Keeper 52 is formed along guide channel 46 to retain operator catch 42 in guide channel 46 when operator catch 42 is acted upon by the biasing force supplied by biasing member 44. Key 54 includes a plurality of key members 58, which are respectively received in the plurality of key slots 32 of keyway 30 formed in operator sleeve 20. Retainer 56 is positioned to engage bore 24 of operator sleeve 20 when operator catch cartridge assembly 16 is fully inserted as a unit into first opening 26 in operator sleeve 20 of chassis 12, so as to inhibit removal of operator catch cartridge assembly 16 from chassis 12.

Operator catch 42 includes a body 60 having a catch member 62, a first elongate member 64 and a second elongate member 66. Catch member 62 is positioned with respect to body 60 opposite to elongate members 64, 66. Elongate member 64 is configured to be received in first spring chamber 48, and is biased by spring 44*a*. Elongate member 66 is configured to be received in second spring chamber 50, and is biased by spring 44*b*. A slit 68 is formed in catch member 62 to define a retainer surface 70.

Figure 5:
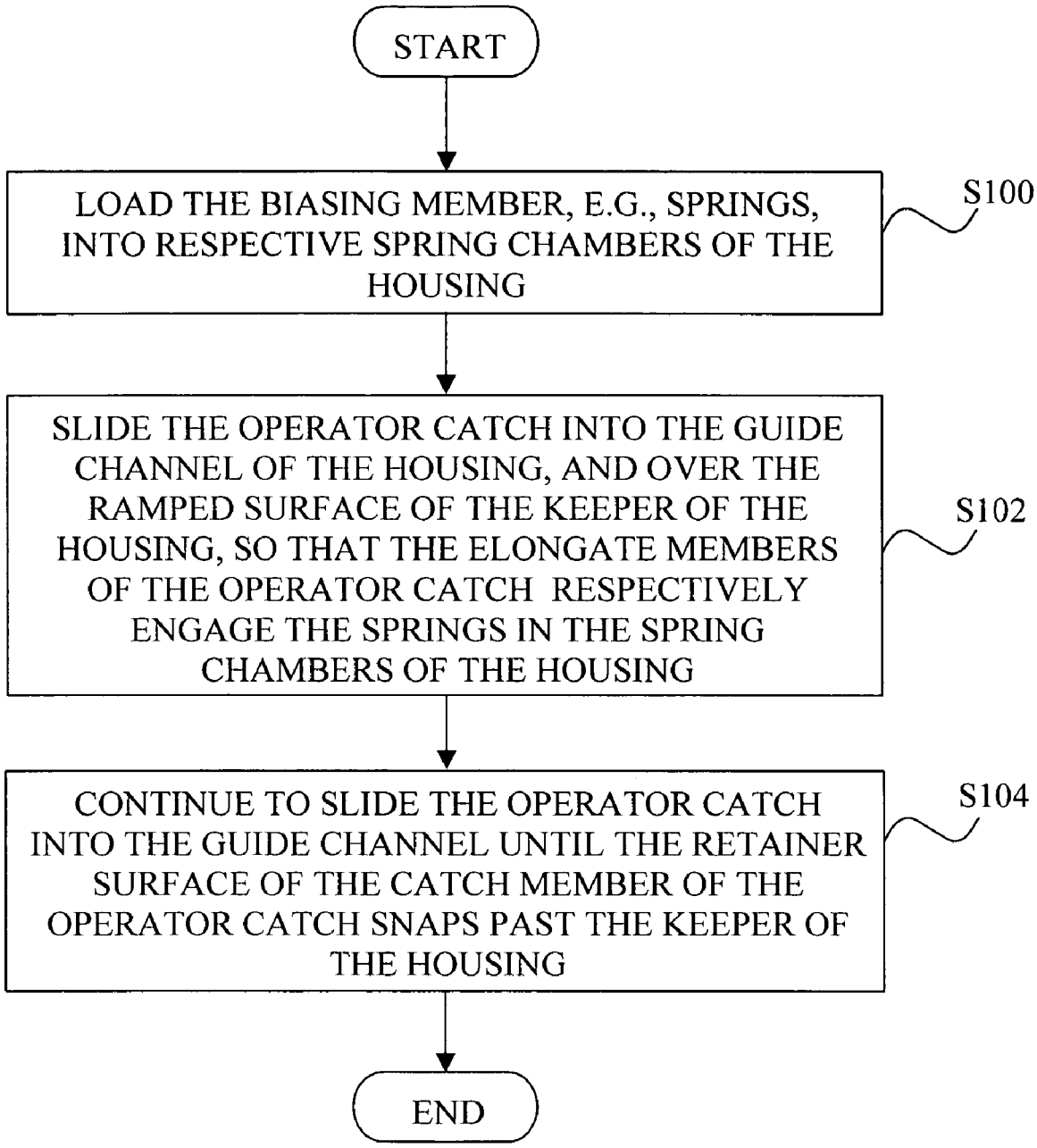
FIG. 5 is a flowchart of a method of assembling the operator catch cartridge assembly of FIGS. 2–4.

FIG. 5 is a flowchart of a method of assembling operator catch cartridge assembly 16.

At step S100, springs 44*a*, 44*b* are respectively loaded into spring chambers 48, 50 of housing 40.

At step S102, operator catch 42 is slid into guide channel 46 over the ramped surface of keeper 52, and with elongate members 64, 66 respectively engaging springs 44*a*, 44*b* in spring chambers 48, 50 of housing 40.

At step S104, operator catch 42 continues to be slid into guide channel 46 until retainer surface 70 of catch member 62 of operator catch 42 snaps past keeper 52 of housing 40, at which time assembly of operator catch cartridge assembly 16 is complete.

Figure 6:
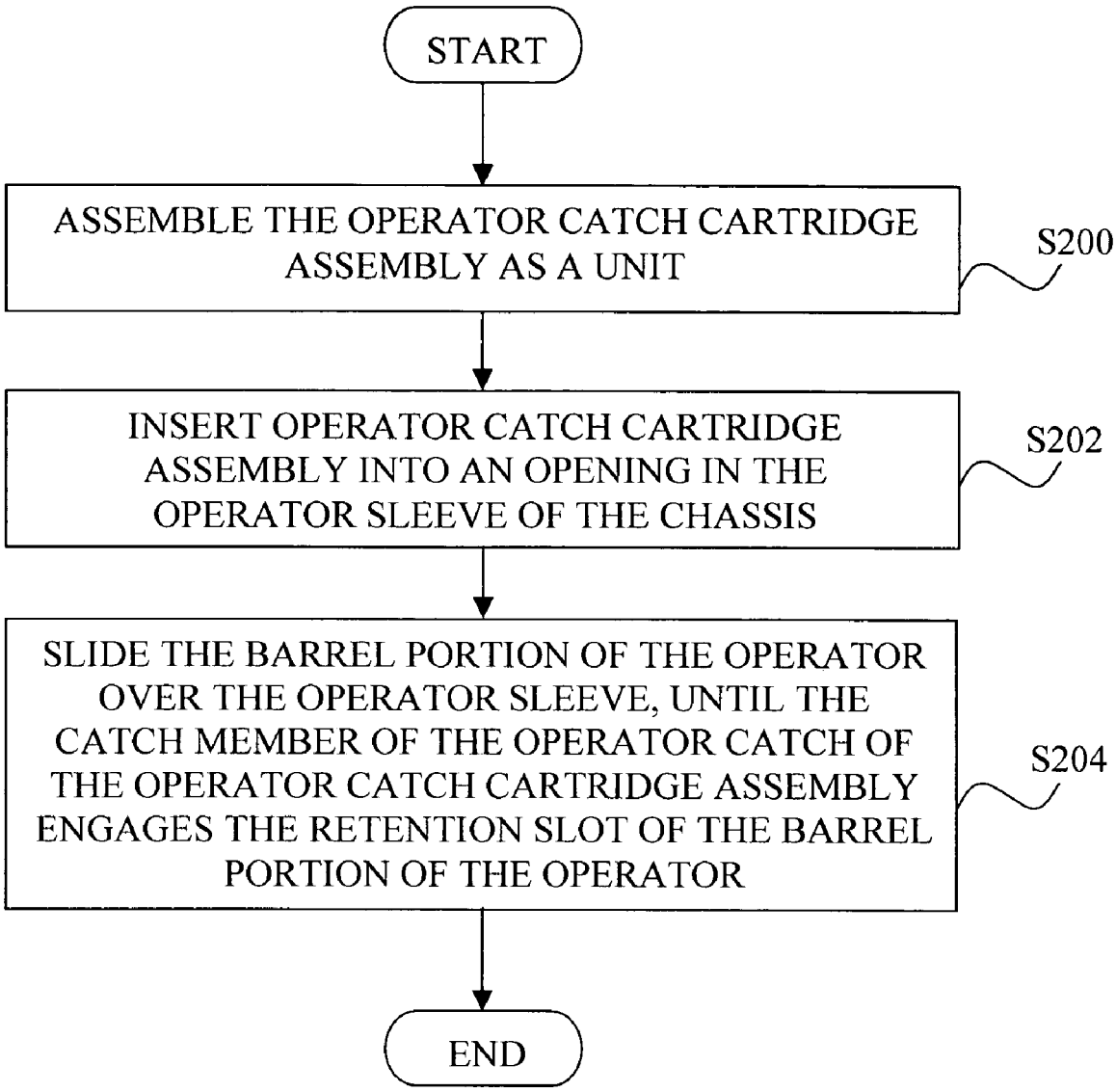
FIG. 6 is a flowchart of a method of assembling the handle set of FIG. 1A.

FIG. 6 is a flowchart of a method of assembling handle set 10.

At step S200, operator catch cartridge assembly 16 is assembled as a unit, as described above with respect to FIG. 5. In summary, operator catch 42 is positioned in guide channel 46 for sliding engagement with housing 40, and a biasing member 44 positioned in housing 40 biases operator catch 42 with respect to housing 40.

At step S202, operator catch cartridge assembly 16 is inserted into first opening 26, through bore 24, and into second opening 28, in operator sleeve 20 of chassis 12.

At step S204, barrel portion 36 of operator 14 is slid over operator sleeve 20, until catch member 62 of operator catch 42 of operator catch cartridge assembly 16 engages retention slot 38 of barrel portion 36 of operator 14, which in turn retains operator 14 on operator sleeve 20 of chassis 12.

Removal of operator 14 from operator sleeve 20 may be effected by using a tool, such as a thin bladed screw driver, to depress operator catch 42, while exerting a pulling force on operator 14.

While this invention has been described with respect to one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A handle set, comprising:

an operator having a retention slot;

a chassis for mounting said operator, said chassis including a sleeve having a bore, and a first opening extending through said sleeve to said bore; and an operator catch cartridge assembly configured for mounting to said chassis by insertion of said operator catch cartridge assembly into said first opening, said operator catch cartridge assembly including a housing defining a guide channel, an operator catch positioned in said guide channel for sliding engagement with said housing, and a biasing member for biasing said operator catch with respect to said housing, said operator catch engaging said retention slot in said operator when said operator is received over said sleeve of said chassis, said sleeve of said chassis including a second opening extending through said sleeve to said bore and positioned opposite to said first opening, said operator catch extending from said second opening in said sleeve when said operator catch cartridge assembly is installed in said chassis.

2. The handle set of claim 1, said first opening of said sleeve of said chassis defining a keyway, and said housing of said operator catch cartridge assembly including a key configured to be received in said keyway.

3. The handle set of claim 2, said keyway defining a plurality of key slots and said key defining a corresponding plurality of key members.

4. The handle set of claim 1, said housing of said operator catch cartridge assembly including a retainer to inhibit removal of said operator catch cartridge assembly from said chassis.

5. The handle set of claim 1, said housing being made of plastic.

6. The handle set of claim 1, said sleeve of said chassis including a side wall through which said first opening extends to said bore.

7. The handle set of claim 1, said sleeve of said chassis including a cylindrical wall through which said first opening extends to said bore.

8. A handle set, comprising:

an operator having a retention slot;

a chassis for mounting said operator, said chassis including a sleeve having a bore, and a first opening extending through said sleeve to said bore; and an operator catch cartridge assembly configured for mounting to said chassis by insertion of said operator catch cartridge assembly into said first opening, said operator catch cartridge assembly including a housing defining a guide channel, an operator catch positioned in said guide channel for sliding engagement with said housing, and a biasing member for biasing said operator catch with respect to said housing, said operator catch engaging said retention slot in said operator when said operator is received over said sleeve of said chassis, said biasing member including a pair of springs, said guide channel defining in said housing a first spring chamber and a second spring chamber, each of said first spring chamber and said second spring chamber respectively receiving one of said pair of springs.

9. The handle set of claim 8, said operator catch including a body having a catch member, a first elongate member and a second elongate member, said first elongate member being received in said first spring chamber and said second elongate member being received in said second spring chamber.

10. A handle set, comprising:

an operator having a retention slot;

a chassis for mounting said operator, said chassis including a sleeve having a bore, and a first opening extending through said sleeve to said bore; and an operator catch cartridge assembly configured for mounting to said chassis by insertion of said operator catch cartridge assembly into said first opening, said operator catch cartridge assembly including a housing defining a guide channel, an operator catch positioned in said guide channel for sliding engagement with said housing, and a biasing member for biasing said operator catch with respect to said housing, said operator catch engaging said retention slot in said operator when said operator is received over said sleeve of said chassis, said housing of said operator catch cartridge assembly including a keeper formed along said guide channel to retain said operator catch in said guide channel.

11. An operator catch cartridge assembly configured for mounting as a unit to a chassis, said chassis being configured to receive an operator, said operator catch cartridge assembly comprising:

a housing defining a guide channel;

an operator catch positioned in said guide channel for sliding engagement with said housing; and a biasing member for biasing said operator catch with respect to said housing, said operator catch being configured to engage a retention slot in said operator to retain said operator on said chassis, said housing, said operator catch and said biasing member being assembled as a cartridge assembly, said biasing member including a pair of springs, said guide channel defining in said housing a first spring chamber and a second spring chamber, each of said first spring chamber and said second spring chamber respectively receiving one of said pair of springs.

12. The operator catch cartridge assembly of claim 11, said housing including an external key for engaging a corresponding keyway in said chassis.

13. The operator catch cartridge assembly of claim 11, said housing including a retainer to inhibit removal of said operator catch cartridge assembly from said chassis.

14. The operator catch cartridge assembly of claim 11, said operator catch including a body having a catch member, a first elongate member and a second elongate member, said first elongate member being received in said first spring chamber and said second elongate member being received in said second spring chamber.

15. The operator catch cartridge assembly of claim 11, said housing including a keeper formed along said guide channel to retain said operator catch in said guide channel.

16. The operator catch cartridge assembly of claim 11, said housing being made of plastic.

17. A method of assembling a handle set, comprising the steps of:

assembling an operator catch cartridge assembly as a unit, said operator catch cartridge assembly including a housing defining a guide channel, an operator catch positioned in said guide channel for sliding engagement with said housing, and a biasing member for biasing said operator catch with respect to said housing;

inserting said operator catch cartridge assembly into a side wall opening in an operator sleeve of a chassis; and sliding a barrel portion of an operator over said operator sleeve, said barrel portion having a retention slot, said operator catch of said operator catch cartridge assembly engaging said retention slot in said operator to retain said operator on said operator sleeve.

* * * * *